US005088412A

United States Patent [19]

Patrichi

[11] Patent Number: 5,088,412

[45] Date of Patent: Feb. 18, 1992

[54] ELECTRICALLY-INITIATED TIME-DELAY GAS GENERATOR CARTRIDGE FOR MISSILES

[75] Inventor: Mihai D. Patrichi, Los Angeles, Calif.

[73] Assignee: Networks Electronic Corp., Chatsworth, Calif.

[21] Appl. No.: 556,636

[22] Filed: Jul. 16, 1990

[51] Int. Cl.[5] ..... F42C 9/10; F42C 19/02

[52] U.S. Cl. ..... 102/202.13; 102/202.5; 149/19.3; 149/37

[58] Field of Search ..... 102/202, 202.5, 202.13; 149/37, 19.3, 22

[56] References Cited

U.S. PATENT DOCUMENTS

| | | | |
|---|---|---|---|
| 2,103,014 | 12/1937 | Palmieri et al. | 102/202.5 |
| 2,887,054 | 5/1959 | Bryan | 102/202.13 |
| 3,078,799 | 2/1963 | Kabiki | 102/202.13 |
| 3,572,247 | 3/1971 | Warshall | 102/202.2 |
| 3,897,731 | 8/1975 | Bowman | 102/275.5 |
| 3,898,048 | 8/1975 | Barber et al. | 23/531 |
| 3,972,287 | 8/1976 | Travor et al. | 102/530 |
| 3,999,484 | 12/1976 | Evans | 102/202.13 |
| 4,312,271 | 1/1982 | Day et al. | 102/202.13 |
| 4,422,381 | 12/1983 | Barrett | 102/202.2 |
| 4,429,632 | 2/1984 | Yunan | 102/202.13 |
| 4,527,025 | 7/1985 | Patrichi et al. | 102/263 |
| 4,858,529 | 8/1989 | Lieberman | 102/202.5 |
| 4,860,698 | 8/1989 | Patrichi et al. | 123/24 R |

*Primary Examiner*—Michael J. Carone

*Attorney, Agent, or Firm*—Poms, Smith, Lande & Rose

[57] ABSTRACT

A time delay gas generator for military missiles, characterized by very long shelf life and accurately-determined time delay. Time delay powder is layered at high pressure, and causes heating of a metal disc at the end of a time delay interval that is accurately known. Such heating ignites an output charged to generate gas, the gas breaking a closure and performing a function in the missile.

20 Claims, 1 Drawing Sheet

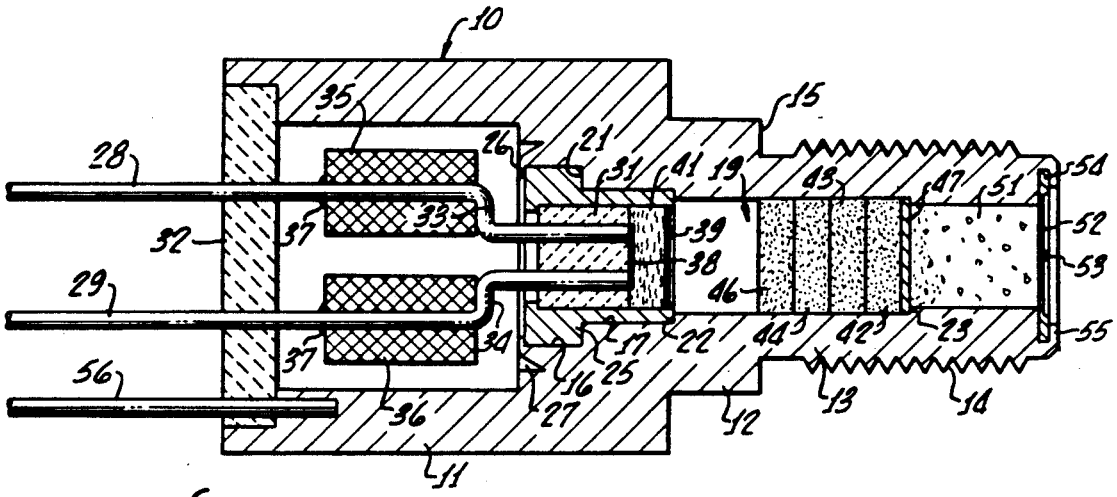
FIG. 1.
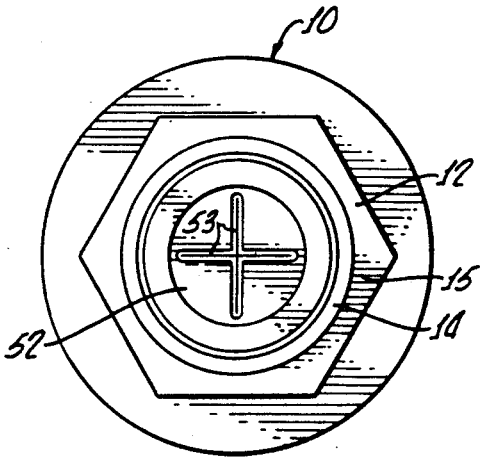
FIG. 2.
FIG. 3.
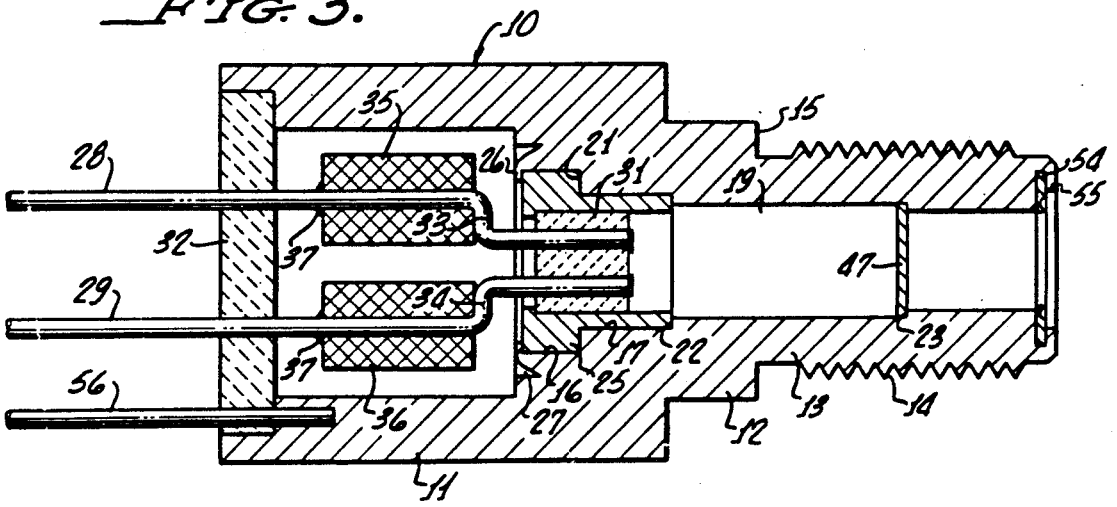

ELECTRICALLY-INITIATED TIME-DELAY GAS GENERATOR CARTRIDGE FOR MISSILES

BACKGROUND OF THE INVENTION

Historically, in commercially-used military gas generators for missiles, it has been conventional to employ electric circuits to create the time delays. Such arrangements, however, have distinct disadvantages a major one of which is short shelf life. The capacitors employed in the delay circuits tend to change characteristics over time, and this makes the gas generators unreliable vis-a-vis delay times.

It is known to use powders to generate time delays in gas generators. However, in one such device the chamber containing the delay powder was vented to the atmosphere so as to prevent the device from being fully sealed. Accordingly, and for other reasons, there was a tendency toward unreliability and lessened shelf life.

Another major disadvantage of the prior art was inability to achieve highly precise powder-column time delays in a gas generator for missiles.

SUMMARY OF THE INVENTION

The present device, which generates precisely-timed delays for the Stinger and other missiles, is believed to have a very long shelf life, of many years.

It is electrically ignited through a circuit which includes electrical filters so as to prevent ignition caused by spurious radiation.

When an ignition signal is delivered to the device, an ignition charge is ignited. The resulting heat is transferred through a void, after disintegrating a seal, to effect ignition of a delay igniter charge. The igniter charge, in turn, ignites the adjacent one of a plurality of layers of delay charges that are packed very tightly under great pressure so as to be highly uniform.

A combination of various factors creates a precisely known reliable time delay, even after passage of many years on the shelf.

Toward the expiration of the delay period, the delay powders heat to red hot condition a barrier disc against which the delay powders were compressed. The hot disc ignites a gas generating output charge, which charge includes an output ignition powder. The gas generator ruptures a sealing disc having a cruciform slot therein, so that gases at hundreds of psi are transmitted to a desired region of the Stinger or other missile.

The gas generator device generates pressures of, for example, 400 psi to 700 psi. It will operate with a function time of 170 msec, with a reliable and reproducible tolerance of +18 msec (milliseconds) and −10 msec.

BRIEF DESCRIPTION OF THE DRAWINGS

FIG. 1 is a longitudinal central sectional view showing the present time delay gas generator cartridge for missiles, in its condition prior to firing;

FIG. 2 is an elevational view of the output end of the unfired cartridge, namely the right end of FIG. 1; and FIG. 3 corresponds to FIG. 1 but shows the cartridge in its condition after firing.

DETAILED DESCRIPTION OF THE INVENTION

The device comprises an elongate metal housing 10 that is preferably quite small, for example 1⅓ inches long and ⅜ inch in maximum diameter. The larger-diameter portion of housing 10 is a hollow cylindrical body 11.

Body 11 connects coaxially through a smaller diameter hexagonal neck 12 (FIGS. 1 and 2) with a head 13 of still-smaller diameter. Head 13 is externally threaded at 14 so that the device may be threaded into an internally threaded opening, such threading continuing until a shoulder 15, namely a radial forward face of neck 12, engages the component into which the device is threaded.

The chamber defined within the hollow cylindrical body 11 is cylindrical and coaxial of such body 11, and communicates coaxially with a much smaller-diameter chamber having a cylindrical peripheral wall 16. Such chamber connects coaxially with a still smaller-diameter chamber having a cylindrical peripheral wall 17. The last-mentioned chamber communicates coaxially with a stepped elongate passage 19 that extends clear to the inner or forward end of the housing 10. Such passage preferably extends for about ½ the length of such housing.

There is a radial shoulder 21 extending between walls 16 and 17, and a second radial shoulder 22 extending inwardly from cylindrical wall 17 to the cylindrical wall of the elongate stepped passage 19. An additional shoulder, indicated at 23, separates a larger diameter cuter portion of passage 19 from a smaller diameter inner or forward portion thereof.

An ignition subassembly, including means to prevent undesired ignition of the device by stray electromagnetic fields, is provided and inserted into the above-described chambers outwardly of passage 19. This comprises a metal eyelet 25 having a tubular body and a thick flange. Such body and flange fit snugly in the described cylindrical chambers having walls 16, 17, being in close contact with such walls. The flange seats against shoulder 21, while the forward end of the body seats against shoulder 22, thus effectively determining the exact position of eyelet 25 in the chambers.

The eyelet and associated parts are held tightly in the chambers by a crimped neck 26 that is crimped around the outer corner of the eyelet flange. Such neck is formed from the metal of body 11 peripherally of the eyelet, there being an annular groove for this purpose as illustrated at 27.

Relatively large diameter leads or wires 28, 29 are fixedly secured in the housing 10 and in eyelet 25, the inner or forward ends of the wires being fused in a mass 31 of glass. Portions of the wires 28, 29 at the outer end of housing 11 are held in position, in sealed relationship, by an epoxy disc 32. Such disc is seated at the outer end of body 11 adjacent shoulder portion provided at such outer end.

The wires 28, 29 are kinked or offset outwardly at 33, 34. Filters 35, 36 are threaded coaxially on wires 28, 29 and abutted with the offset regions 33, 34, being held there by adhesive indicated at 37.

The filters 35, 36 are thus effectively and economically held in the chamber defined within body 11, and are effectively sealed by epoxy 32 and other sealing elements. The filters are preferably of the ferrite type, 200 Mhz. They operate to prevent melting of the small-diameter bridge wire 38 that extends between wires 28, 29 at the inner face of glass 31, until such time as a signal is intentionally transmitted through such wires 28, 29 when ignition is desired.

The forward or inner ends of wires 28, 29 are ground flush with the inner face of glass 31, and the plane of such face and the wire ends is spaced inwardly from the shoulder 22. A Mylar disc 39 is provided in spaced relationship from such face, being held in mounted and sealed relationship by suitable adhesive.

The space between Mylar disc 39 and the forward face of glass 31 contains ignition powder 41. The ignition powder 41 may be an of numerous ignition systems known in the art with the appropriate ignition sensitivity, heat generating characteristics, and storage properties. An oxidant/fuel pair consisting of boron/calcium chromate is particularly suitable. However, mixtures of magnesium, aluminum, titanium, or zirconium with oxidants such as ammonium or potassium perchlorate, barium or potassium nitrate, barium or lead chromate, or cupric or lead oxides may be formulated to meet the ignition requirements of this device.

Provided in passage 19, outwardly of shoulder 23 in such passage, is the delay column for achieving a precise desired time delay, such delay column having a very long shelf life as above stated. The layers of the delay column are packed against each other, and the inner (forward) one is packed against a metal barrier disc 47 that is provided across passage 19. Stated more specifically, the periphery of disc 47 is seated against the shoulder 23 at the junction between the larger diameter and smaller diameter portions of the stepped elongate passage 19.

In the illustrated embodiment there are three layers 42, 43 and 44 of delay powder, layer 42 being in direct engagement with the barrier disc 47. The layers 42–44 are preferably of equal thickness relative to each other. Layer 42 is pressed against disc 47 at a pressure on the order of 30,000 psi. Thereafter, layer 43 is pressed against layer 42 at the same pressure, following which layer 44 is pressed against layer 43 at the same pressure.

Thereafter, a delay igniter powder 46 is pressed against the outermost delay layer 44, in substantially spaced relationship from the Mylar disc 39 and ignition powder 41. Thus, a substantial void is present between delay igniter powder 46 and ignition powder 41. Such void operates, for example, to provide extreme uniformity of temperature across the outer face of igniter powder 46 after ignition powder 41 is fired.

Delay igniter 46 may be any of several suitable ignition systems which achieve uniform and substantially instant generation and transfer of igniting caloric energy to the delay discs 42–44. Additionally, the delay igniter must be capable of ignition at the temperatures supplied by the powder 41 and transferred through the void in the delay column housing. Preferably, lead mononitroresorcinate utilized for this purpose, however; a zirconium/barium chromate igniter pair also provides the required heat transfer characteristics.

The delay powders which form layers 42–44 are crucial to the function time of the gas generator. Such delay powders must burn reliably to provide a predetermined function time at a temperature which is sufficient to ignite the output initiator powder described below. Function times are determined by 1) the burning properties or sensitivity to caloric energy of the powder, 2) the ratio of the amount of oxidant to fuel in the powder, 3) the packing density of the delay column powders, and 4) the height (length) of the delay column (or the number of layers of delay powder). The volume in the housing passage which is available for packing is also a factor, since a particularly small volume may limit the height of the delay column.

Accordingly, the function time may be altered by varying any of the determining parameters within the limits of the available volume. For applications which do not require function time tolerances of less than 25 msec, the powder mixtures and packing densities are less critical than they are relative to more demanding tolerance requirements. For example, tungsten powders combined with oxidants such as barium chromate and potassium perchlorate with a diatomaceous earth binder will burn reliably with the desired caloric energy, and with meticulously uniform packing densities and column packing heights, function time tolerances of somewhat less than 25 msec can be achieved. However, the tungsten fuel systems are better suited for less demanding applications. Additionally, such fuel systems are somewhat s sensitive to moisture and will lose activity with long term storage.

For systems demanding function times with tolerances of +/− about 10 to 20 msec, the packing density and the fuel and oxidant in column layers 42–44 are especially critical. In accordance with the present invention, columns with function times having tolerances which vary by less than 18 msec can be achieved, in a practical manner with long shelf life for the device. Such columns are suitable as reliable functional replacements for delay circuits, which contain capacitors. When appropriately stored the present delay columns will, it is predicted, remain active for at least 15 to 20 years. Similar systems which utilize capacitor circuits to achieve a delay in function are subject to failure, producing a "dud", within 5 years. Such circuit failures are caused by capacitor discharge or the inability of the capacitor to continue to hold a charge with time.

Function times of less than 300 msec, with reliably reproducible tolerances of less than 18 msec, are achieved by using as delay powders zirconium metal in combination with a red iron oxide (Fe203) and a diatomaceous earth binder. This preferred combustion system has a low sensitivity to moisture, which results in no or very little function time change with storage. Additionally, it is believed that as the oxides of zirconium form during combustion they flake off easily, thereby exposing fresh metallic surfaces to attack by the oxidizer. The constant availability of the metallic fuel element probably provides a dependable and reproducible function time for each device, provided there is a particular packing density, column height, and fuel/oxidizer ratio.

In general the delay powders do not generate substantial gases. However, at the temperatures at which the fuel burns the combustion products will expand. The additional volume, namely the described void, in the stepped elongate passage provides an expansion volume without requiring a vent system for the gas generator.

Once the delay powder has fired, the heat is transferred to barrier disc 47 in contact with an output charge 51. The output charge comprises a mixture of output ignition powder and gas generator powders. The temperature of disc 47 is increased to red hot condition, which ignites an output ignition powder portion of the output charge. The output ignition powder is sensitive to the heat from the disc and easily ignites to provide an even and instant heat transfer to the gas generator powders. These latter powders ignite as a result of the heat transfer from the ignition powder, and burn explosively with a gas and heat output sufficient to generate pressures of several hundred psi.

The output charge 51 is determinative of the gas pressures generated by the device. The nature of the output charge powders, the ratio of fuel to oxidant in the charge, and the amount of each which is present, all contribute to the final pressure.

Output ignition powders are contained in the output charge. These have sensitive ignition properties suitable for efficient and instant transfer of the caloric energy from disc 47 to gas generator powders. Ignition powders include potassium dinitrobenzofuroxan in a diatomaceous earth binder. Lead mononitroresorcinate is also a suitable igniter.

The heat transferred by this ignition powder effectively ignites the gas generator powders which consist of gas producing explosive materials in combination or alone. A particularly suitable explosive material consists of a mixture of approximately 5% nitroglycerine and about 95% nitrocellulose. The nitrocellulose, nitroglycerine pair burns with an explosive burst producing gases from the burning hydrocarbons. Other output charges which may be used in combination include a number of fuel/oxidants which burn evenly and at a rate which produces sufficient gases to develop the desired pressures.

To achieve gas generating devices which will generate pressures in the range of 400 psi to 700 psi, the fuel/oxidant mixture of boron/potassium nitrate/zinc oxide combined with a fluoroelastomer such as Viton (TM) available from Dupont are particularly suitable. The fluorocarbon gases emitted from the output charge provide the pressure within the desired range. Additionally, the boron provides burning temperatures within a range sufficient to decompose the fluorocarbon which vaporizes to form the output gases.

Gases generated upon burning of the output charge pass instantly out the inner end of passage 19, through a sealing disc 52 having cruciform groove means 53 therein, reference being made to FIG. 2. The peripheral region of disc 52 is relatively thick, as shown at 54, and is held in position by a crimped annular region 55 at the inner end of head 13 of the housing.

The post-fired position of the present device is shown in FIG. 3. It is pointed out that the barrier disc 47 is still in position, after firing, despite the fact that there is no vent communicating with the portion of passage 19 upstream from the barrier disc 47.

PREFERRED EXAMPLE

A gas generator having the construction shown in the present drawings was produced using the following procedure and materials:

The housing 10 was first manufactured, following which the disc 47 was disposed against shoulder 23. The delay column was then formed by packing three layers 42, 43, 44 of powder. First layer 42 was packed first, by applying a pressure of about 30,000 psi against the powder introduced into the passage adjacent the disc 47. In the same manner, the second layer 43 was packed against the first layer 42. Thereafter, in the same manner, the third layer 44 was packed against the second layer 43. Thereafter, the delay ignition powder 48 was packed against delay layer 44.

The three separate delay powder layers 42–44 each consisted of a combination of zirconium/red iron oxide/diatomaceous earth. The preferred delay powders are commercially available under the designation AIA from Pyrotechnics Specialties Co. of Georgia. The three delay powder layers are of equal mass and height and total approximately 500 mg (milligrams) in weight. The delay igniter powder 46 consisted of approximately 30 mg of zirconium/barium chromate oxidant fuel pair.

The ignition subassembly described above was manufactured, and filled adjacent glass 31, with approximately 40 mg of boron/calcium chromate oxidant fuel pair mixture. Such powder was packed into the eyelet 25, following which the Mylar disc 39 was positioned and adhesively sealed in place.

The ignition subassembly was then inserted into the end of housing 10 remote from the head 13. It was held in position by crimping the above-indicated neck as indicated at 26. Epoxy 32 was provided to seal the chamber containing the filters 35, 36, and to seal around the wires 28, 29. A third wire 56 was also provided, being inserted into a bore in the hollow cylindrical body 11 of housing 10 so as to provide a ground.

The output charge was placed adjacent the disc 47. It comprised a mixture of approximately 20 mg of a combination of potassium dinitrobenzofuroxan/diatomaceous earth, approximately 15 mg of a combination of nitroglycerine and nitrocellulose, and approximately 30 mg of a combination of boron/potassium nitrate/-Viton/zinc oxide. The sealing disc 52 was then positioned, and was held in position by crimping the extreme inner end of housing 10 around the relatively thick peripheral region 54 of such disc.

The gas generator described in such example generates pressures of from 400 psi to 700 psi. It will also operate with a function time of 170 msec with a reliable and reproducible tolerance of +18 msec and −10 msec.

The foregoing detailed description is to be clearly understood as given by way of illustration and example only, the spirit and scope of this invention being limited solely by the appended claims.

What is claimed is:

1. An electrically-initiated time-delay gas generator, which comprises:

(a) a housing having an elongate passage therein, said passage having an inner end portion that extends to an end of said housing. said housing having a relatively large diameter hollow body portion and a relatively small diameter head portion, said body portion having a relatively large chamber therein, said body portion and said head portion being coaxial, said elongate passage extending from said relatively large chamber to the inner end of said head portion, (b) filter means provided in said relatively large chamber in circuit with said igniter assembly to prevent undesired firing of said igniter assembly, (c) a metal barrier disc mounted in said passage transversely thereof so as to block said passage, said barrier disc being spaced from the inner end of said passage, the portion of said passage on the opposite side of said barrier disc from said inner passage end being unvented, (d) an output seal provided in sealing relationship across said inner end of said passage so as to seal the portion of said passage between said barrier disc and said inner end, said output seal being adapted to rupture and permit rapid escape of gas from said last-mentioned passage portion, (e) an electrically-operated igniter assembly communicating with the outer end of said passage, said igniter assembly including ignition powder and means to effect burning of said powder when an electric current is delivered to said igniter assembly, (f) a delay column comprising a plurality of layers of delay powder provided in said passage between said igniter assembly and said barrier disc, said layers being compressed in place in said passage at pressures, sufficiently high to provide function time tolerances of less than 25msec, the outer one of said layers being packed against said barrier disc, (g) an igniter layer provided in said passage between said delay column and said igniter assembly, said igniter layer being packed against said delay column, and (h) an output charge provided in said passage between said barrier disc and said output seal, said delay column being adapted to burn over an accurately predetermined time period and then to heat said barrier disc, said barrier disc being thus heated to ignite and generate high-pressure gas.

2. The invention as claimed in claim 1, in which a neck portion is provided on said housing between said body portion and said head portion, said passage passing through said neck portion, and in which said head portion is externally threaded.

3. The invention as claimed in claim 1, in which said hollow body portion also has a relatively small chamber therein, and in which said igniter assembly comprises an eyelet inserted into said relatively small chamber, said eyelet and said relatively small chamber being coaxial with said passage, said eyelet having wires extended herein after passing through said relatively large chamber in said hollow body of said housing, said wires in said relatively small chamber being fused in glass, the outer face of said glass being spaced from an outer end of said eyelet, said eyelet containing outwardly of said glass an ignition charge, and in which a seal is provided to maintain said ignition charge in said eyelet.

4. The invention as claimed inn claim 3, in which said eyelet is spaced a substantial distance from said igniter layer to thereby provide a void in a portion of said passage, said void causing uniformity of temperature of products of combustion that pass from said eyelet to said igniter layer.

5. The invention as claimed in claim 4, in which means are provided to close and seal the end of said housing remote from said head, said seal means having said wires passed therethrough.

6. The invention as claimed in claim 4, in which means are provided to close and seal the end of said housing remote from said head, said seal means having said wires passed therethrough, and in which said igniter layer comprises monitroresorcinate powder.

7. The invention as claimed in claim 4, in which means are provided to close and seal the end of said housing remote from said head, said seal means having said wires passed therethrough, in which said igniter layer comprises mononitroresorcinate powder, and in which said output charge comprises a mixture of powders, said powders being boron/potassium nitrate/zinc oxide combined with a fluoroelastomer.

8. The invention as claimed in claim 7, in which said delay layers are highly compressed, the amount of compression being that achieved by packing them at a pressure of about 30,000 psi.

9. The invention as claimed in claim 1, in which said igniter layer comprises monitroresorcinate powder.

10. The invention as claimed in claim 1, in which said output charge comprises a mixture of powders, said powders being boron/potassium nitrate/zinc oxide combined with a fluoroelastomer.

11. An electrically-initiated time-delay gas generator, which comprises:

(a) a housing having an elongate passage therein, said passage having an inner end portion that extends to an end of said housing, (b) a metal barrier disc mounted in said passage transversely thereof so as to block said passage, said barrier disc being spaced from the inner end of said passage, the portion of said passage on the opposite side of said barrier disc from said inner passage end being unvented, (c) an output seal provided in sealing relationship across said inner end of said passage so as to seal the portion of said passage between said barrier disc and sad inner end, said output seal being adapted to rupture and permit rapid escape of gas from said last-mentioned passage portion, (d) an electrically-operated igniter assembly communicating with the outer end of said passage, said assembly including ignition powder and means to effect burning of said powder when an electric current is delivered to said igniter assembly, (e) a delay column comprising a plurality of layers of delay powder provided in said passage between said igniter assembly and said barrier disc, said plurality of layers in said delay column comprising a combination of zirconium metal powder, red iron dioxide powder, and diatomaceous earth binder powder, said layers being compressed in place in said passage at pressures sufficiently high to provide function time tolerances of less than 25 msec, the outer one of said layers being packed against said barrier disc, (f) an igniter layer provided in said passage between said delay column and said igniter assembly, said igniter layer being packed against said delay column, and (g) an output charge provided in said passage between said barrier disc and said output seal, said delay column being adapted to burn over an accurately predetermined time period and then to heat said barrier disc, said barrier disc being thus heated to ignite and generate high-pressure gas.

12. The invention as claimed in 11, in which each of said layers of said delay column is highly compressed, the amount of compression being that resulting from packing at a pressure of about 30,000 psi.

13. An electrically-initiated time-delay gas generator, which comprises:

(a) a housing having an elongate passage therein, said passage having an inner end portion that extends to an end of said housing, (b) a metal barrier disc mounted in said passage transversely thereof so as to block said passage, said barrier disc being spaced from the inner end of said passage, the portion of said passage on the opposite side of said barrier disc from said inner passage end being unvented, (c) an output seal provided in sealing relationship across said inner end of said passage so as to seal the portion of said passage between said barrier disc and said inner end, said output seal being adapted to rupture and permit rapid escape of gas from said last-mentioned passage portion, (d) an electrically-operated igniter assembly communicating with the outer end of said passage, said igniter assembly including ignition powder and means to effect burning of said powder when an electric current is delivered to said igniter assembly, (e) a delay column comprising a plurality of layers of delay powder provided in said passage between said igniter assembly and said barrier disc, said layers of delay powder comprising a combination of zirconium metal powder, red iron oxide powder, and diatomaceous earth binder powder and said layers being compressed in place in said passage at a high compression pressure of about 30,000 psi, the outer one of said layers being packed against said barrier disc, (f) an igniter layer provided in said passage between said delay column and said igniter assembly, said igniter layer being packed against said delay column, and (g) an output charge provided in said passage between said barrier disc and said output seal, said delay column being adapted to burn over an accurately predetermined time period and then to heat said barrier disc, said barrier disc being thus heated to ignite and generate high-pressure gas.

14. The invention as claimed in claim 13, in which said housing has a relatively large diameter hollow body portion and a relatively small diameter head portion, sad body portion having a relatively large chamber therein, said body portion and said head portion being coaxial, inn which said elongate passage extends from said relatively large chamber to the inner end of said head portion, and inn which filter means are provided in said relatively large chamber in circuit with said igniter assembly to prevent undesired firing of said igniter assembly.

15. The invention as claimed in claim 14, in which a neck portion is provided on said housing between said body portion and said head portion, said passage passing through said neck portion, and in which said head portion is externally threaded.

16. The invention as claimed in claim 14, in which said hollow body portion also has a relatively small chamber therein, and in which said igniter assembly comprises an eyelet inserted into said relatively small chamber, said eyelet and said relatively small chamber being coaxial with said passage, said eyelet having wires extended herein after passing through said relatively large chamber in said hollow body of said housing, said wires in said relatively small chamber being fused in glass, the outer face of said glass being spaced from an outer end of said eyelet, said eyelet containing outwardly of said glass an ignition charge, and inn which a seal is provided to maintain said ignition charge in said eyelet.

17. The invention as claimed in claim 16, in which said eyelet is spaced a substantial distance from said igniter layer to thereby provide a void in a portion of said passage, said void causing uniformity of temperature of products of combustion that pass from said eyelet to said igniter layer.

18. The invention as claimed in claim 17, in which a means are provided to close and seal the end of said housing remote from said head, said seal means having said wires passed therethrough.

19. The invention as claimed in claim 17, in which means are provided to close and seal the end of said housing remote from said head, said seal means having said wires passed therethrough, and in which said igniter layer comprises mononitrorescorcinate powder.

20. The invention as claimed in claim 17, in which means are provided to close and seal the end of said housing remote from said head, said seal means having said wires passed therethrough, in which said igniter layer comprises mononitrorescorcinate powder, and inn which said output charge comprises a mixture of powders, said powders being boron/potassium nitrate/zinc oxide combined with a fluoroelastomer.

* * * * *